US007424237B2

(12) United States Patent
Ushio et al.

(10) Patent No.: US 7,424,237 B2
(45) Date of Patent: Sep. 9, 2008

(54) IMAGE FORMING APPARATUS AND IMAGE FORMING METHOD

(75) Inventors: Masaru Ushio, Hachioji (JP); Takaaki Sakai, Hachioji (JP); Akio Ueda, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 101 days.

(21) Appl. No.: 10/915,894

(22) Filed: Aug. 10, 2004

(65) Prior Publication Data

US 2005/0100358 A1 May 12, 2005

(30) Foreign Application Priority Data

Nov. 6, 2003 (JP) ..... 2003-377443

(51) Int. Cl.
*G03G 15/00* (2006.01)

(52) U.S. Cl. ..... 399/82; 399/408

(58) Field of Classification Search ..... 399/364, 399/407, 408, 82

See application file for complete search history.

(56) References Cited

U.S. PATENT DOCUMENTS 4,763,167 A * 8/1988 Watanabe et al. ..... 347/155
5,105,230 A * 4/1992 Emori ..... 399/14
5,461,459 A * 10/1995 Muramatsu et al. ..... 399/408 X

* cited by examiner

*Primary Examiner*—David M Gray
*Assistant Examiner*—Erika J. Villaluna
(74) *Attorney, Agent, or Firm*—Squire, Sanders & Dempsey L.L.P.

(57) ABSTRACT

An image forming apparatus capable of recording images of a double sided original on both sides of a recording sheet, the image forming apparatus having, an image reader for reading images of the double sided original, a first setting section for setting a binding direction of the double sided original, a second setting section for setting a binding direction of the recording sheet with relating to the binding direction set by the first setting section, and an image rotator for making a required amount of rotation of an image read by the image reader, based on the binding directions having been set by the first setting section and by the second setting section.

13 Claims, 15 Drawing Sheets

FIG. 6

430

| | | | |
|---|---|---|---|
| SET DATA | SET NUMBER OF COPIES | 1 | |
| | OUTPUTTED COPIES | — | |
| | COPY MODE | ADF DOUBLE SIDE | |
| | OUTPUT MODE | DOUBLE SIDE | |
| | TRAY USED | TRAY 1 | |
| | OUTPUT SIZE | — | |
| | NUMBER OF READ IMAGES | — | |
| | NUMBER WRITTEN IMAGES | — | |
| | DOCUMENT BINDING DIRECTION | LATERAL BIND | 431 |
| | DOCUMENT TYPE/SET DIRECTION | NORMAL SET | |
| | DOCUMENT SIZE | — | |
| | OUTPUT BINDING DIRECTION | LATERAL BIND | 432 |

FIG. 13

700

701

| | | | |
|---|---|---|---|
| JOB DATA | | SET NUMBER OF COPIES | 1 |
| | | OUTPUTTED COPIES | 0 |
| | | COPY MODE | ADF DOUBLE SIDE |
| | | OUTPUT MODE | DOUBLE SIDE |
| | | TRAY USED | TRAY 1 |
| | | OUTPUT SIZE | A4 |
| | | NUMBER OF READ IMAGES | 0 |
| | | NUMBER WRITTEN IMAGES | 0 |
| | | DOCUMENT BINDING DIRECTION | LATERAL BIND |
| | | DOCUMENT TYPE/SET DIRECTION | NORMAL SET |
| | | DOCUMENT SIZE | A4 |
| | | OUTPUT BINDING DIRECTION | LATERAL BIND |
| PAGE DATA | PAGE 1 | IMAGE ROTATIONAL ANGLE AT THE TIME OF OUTPUT | |
| | | IMAGE STORAGE ADDRESS | |
| | PAGE 2 | IMAGE ROTATIONAL ANGLE AT THE TIME OF OUTPUT | |
| | | IMAGE STORAGE ADDRESS | |
| | ~ | | |
| | PAGE N | IMAGE ROTATIONAL ANGLE AT THE TIME OF OUTPUT | |
| | | IMAGE STORAGE ADDRESS | |

702

FIG. 14

710

702

| | | | | |
|---|---|---|---|---|
| JOB DATA | | SET NUMBER OF COPIES | 1 | |
| | | OUTPUTTED COPIES | 0 | |
| | | COPY MODE | ADF DOUBLE SIDE | |
| | | OUTPUT MODE | DOUBLE SIDE | |
| | | TRAY USED | TRAY 1 | |
| | | OUTPUT SIZE | A4 | |
| | | NUMBER OF READ IMAGES | 0 | 714 |
| | | NUMBER WRITTEN IMAGES | 0 | |
| | | DOCUMENT BINDING DIRECTION | LATERAL BIND | |
| | | DOCUMENT TYPE/SET DIRECTION | NORMAL SET | |
| | | DOCUMENT SIZE | A4 | |
| | | OUTPUT BINDING DIRECTION | LATERAL BIND | |
| PAGE DATA | PAGE 1 | IMAGE ROTATIONAL ANGLE AT THE TIME OF OUTPUT | 0 DEG. | 711 |
| | | IMAGE STORAGE ADDRESS | XXXXX(IMAGE MEMORY ADDRESS) | 712 |

FIG. 15

720

723

| | | | |
|---|---|---|---|
| JOB DATA | | SET NUMBER OF COPIES | 1 |
| | | OUTPUTTED COPIES | 0 |
| | | COPY MODE | ADF DOUBLE SIDE |
| | | OUTPUT MODE | DOUBLE SIDE |
| | | TRAY USED | TRAY 1 |
| | | OUTPUT SIZE | A4 |
| | | NUMBER OF READ IMAGES | 1 |
| | | NUMBER WRITTEN IMAGES | 0 |
| | | DOCUMENT BINDING DIRECTION | LATERAL BIND |
| | | DOCUMENT TYPE/SET DIRECTION | NORMAL SET |
| | | DOCUMENT SIZE | A4 |
| | | OUTPUT BINDING DIRECTION | LATERAL BIND |
| PAGE DATA | PAGE 1 | IMAGE ROTATIONAL ANGLE AT THE TIME OF OUTPUT | 0 DEG. |
| | | IMAGE STORAGE ADDRESS | XXXXX(IMAGE MEMORY ADDRESS) |
| PAGE DATA | PAGE 2 | IMAGE ROTATIONAL ANGLE AT THE TIME OF OUTPUT | 0 DEG. |
| | | IMAGE STORAGE ADDRESS | XXXXX(IMAGE MEMORY ADDRESS) |

724

721

722

FIG. 16

730

731

| | | | |
|---|---|---|---|
| JOB DATA | | SET NUMBER OF COPIES | 1 |
| | | OUTPUTTED COPIES | 0 |
| | | COPY MODE | ADF DOUBLE SIDE |
| | | OUTPUT MODE | DOUBLE SIDE |
| | | TRAY USED | TRAY 1 |
| | | OUTPUT SIZE | A4 |
| | | NUMBER OF READ IMAGES | 2 |
| | | NUMBER WRITTEN IMAGES | 0 |
| | | DOCUMENT BINDING DIRECTION | LATERAL BIND |
| | | DOCUMENT TYPE/SET DIRECTION | NORMAL SET |
| | | DOCUMENT SIZE | A4 |
| | | OUTPUT BINDING DIRECTION | LATERAL BIND |
| PAGE DATA | PAGE 1 | IMAGE ROTATIONAL ANGLE AT THE TIME OF OUTPUT | 0 DEG. |
| | | IMAGE STORAGE ADDRESS | XXXXX(IMAGE MEMORY ADDRESS) |
| PAGE DATA | PAGE 2 | IMAGE ROTATIONAL ANGLE AT THE TIME OF OUTPUT | 0 DEG. |
| | | IMAGE STORAGE ADDRESS | XXXXX(IMAGE MEMORY ADDRESS) |

732

733

734

FIG. 17

740

741

| | | | |
|---|---|---|---|
| JOB DATA | | SET NUMBER OF COPIES | 1 |
| | | OUTPUTTED COPIES | 0 |
| | | COPY MODE | ADF DOUBLE SIDE |
| | | OUTPUT MODE | DOUBLE SIDE |
| | | TRAY USED | TRAY 1 |
| | | OUTPUT SIZE | A4 |
| | | NUMBER OF READ IMAGES | 2 |
| | | NUMBER WRITTEN IMAGES | 1 |
| | | DOCUMENT BINDING DIRECTION | LATERAL BIND |
| | | DOCUMENT TYPE/SET DIRECTION | NORMAL SET |
| | | DOCUMENT SIZE | A4 |
| | | OUTPUT BINDING DIRECTION | LATERAL BIND |
| PAGE DATA | PAGE 1 | IMAGE ROTATIONAL ANGLE AT THE TIME OF OUTPUT | 0 DEG. |
| | | IMAGE STORAGE ADDRESS | XXXXX(IMAGE MEMORY ADDRESS) |
| PAGE DATA | PAGE 2 | IMAGE ROTATIONAL ANGLE AT THE TIME OF OUTPUT | 0 DEG. |
| | | IMAGE STORAGE ADDRESS | XXXXX(IMAGE MEMORY ADDRESS) |

742

743

744

IMAGE FORMING APPARATUS AND IMAGE FORMING METHOD

BACKGROUND OF THE INVENTION

The present invention relates to a copying machine equipped with a function of copying a double sided document in duplex printing mode.

When copying a double sided document in duplex printing mode (duplex copying), four combinations of copying can be considered according to the direction of binding the document and the direction of binding the output paper. To be more specific, four combinations are as follows: (1) The document is bound in the lateral direction with respect to the image, and output paper is bound in the lateral direction with respect to the print image; (2) the document is bound in the lateral direction with respect to the image, and output paper is bound in the vertical direction with respect to the print image; (3) the document is bound in the vertical direction with respect to the image, and output paper is bound in the lateral direction with respect to the print image; and (4) the document is bound in the vertical direction with respect to the image, and output paper is bound in the vertical direction with respect to the print image; as shown in FIG. 20.

In the case of lateral binding, the images on the front and back are oriented in the same direction. However, in the case of vertical binding, the paper will be placed upside down when the page is turned. Thus, the image of the front must be kept in the state 180 degrees rotated with respect to that of the back.

As described above, the images on the front and back have different orientations, depending on the direction of binding. To meet various combinations of the directions of binding, the following machine has been proposed: A user specifies if the long side or the short of a double-sided document is to be bound, and if the long side or the short side of the output paper is to be bound. Upon receipt of this information, the machine turns the image in the appropriate direction in conformity to the instruction of this information, thereby carrying out printing operation. Based on the aforementioned information received from the user, the orientation of the document and the orientation in which output paper is set, the machine determines the angle of rotation for the first face of the document image and that for the second face to perform duplex printing. (See Patent Document 1, for example).

In addition to the aforementioned proposal, another proposal is concerned with a copying machine wherein a document can be set in a desired direction on the document platen, independently of the type of the document, by setting the type of a document (portrait or landscape type) and the orientation in which the document is set (short edge feed or long edge feed). (See Patent Document 2, for example).

[Patent Document 1] Official Gazette of Japanese Patent 3289497 (Tokkai-Hei 8-6315)

[Patent Document 2] Official Gazette of Japanese Patent Tokkai-2003-145879

In the machine where the bound side of the double-sided document (long or short side) and the bound side of the output paper (long or short side) are to be specified, it is possible to meet various combinations of the directions of binding. However, this method requires these two conditions to be specified every time duplex copying is carried out, and setting operations are complicated. This has been a problem in the prior art.

The present invention has been made to solve the aforementioned problem. The object of the present invention is to provide means for copying a double sided document in duplex printing, capable of enhancing the operability in specifying the direction of binding, while meeting various combinations of the direction of binding the document and that of binding the output paper.

SUMMARY OF THE INVENTION

The aforementioned object can be attained by the following features of the invention.

(1) An image forming apparatus capable of recording images of a double sided original on both sides of a recording sheet, the image forming apparatus comprising: an image reader for reading images of the double sided original; a first setting section for setting a binding direction of the double sided original; a second setting section for setting a binding direction of the recording sheet with relating to the binding direction set by the first setting section; and an image rotator for making, a required amount of rotation of an image read by the image reader, based on the binding directions having been set by the first setting section and by the second setting section.

(2) An image forming apparatus capable of recording images of a double sided original on both sides of a recording sheet, the image forming apparatus comprising: an image reader for reading images of the double sided original; a first setting section for setting a binding direction of the double sided original; a second setting section for setting a binding direction of the recording sheet with relating to the binding direction set by the first setting section; and an image rotator for making a required amount of rotation of an image read by the image reader, based on the binding directions having been set by the first setting section and by the second setting section; wherein the binding direction of the recording sheet is capable to be set either by the first setting section or by the second setting section.

(3) An image forming apparatus capable of recording images of a double sided original on both sides of a recording sheet, the image forming apparatus comprising: an image reader for reading images of the double sided original; a memory for memorizing a plurality of binding direction data for the double sided original; a selector for selecting a binding direction data from the plurality of binding direction data; a controller capable of setting a binding direction of the recording sheet with relating to the binding direction data selected by the selector; and an image rotator for making a required amount of rotation of an image read by the image reader, based on a combination of the selected binding direction of the double sided original and the binding direction of the recording sheet.

(4) An image forming method capable of recording images of a double sided original on both sides of a recording sheet, the image forming method comprising the steps of: reading images of the double sided original; setting a binding direction of the double sided original; setting a binding direction of the recording sheet with relating to the binding direction; and making a required amount of rotation of an image having been read, based on the binding direction of the double sided original and the binding direction of the recording sheet.

BRIEF DESCRIPTION OF THE DRAWINGS

FIG. 6 is an explanatory diagram of an example of the set data registration table generated by a copying apparatus as an embodiment of the present invention;

FIG. 13 is an explanatory diagram showing an example of the job table generated by a copying apparatus as an embodiment of the present invention at the time of starting the job;

FIG. 14 is an explanatory diagram showing an example of the job table where the data is set by image read preparation processing applied to the front of a document;

FIG. 15 is an explanatory diagram showing an example of the job table where the data is set by image read preparation processing applied to the back of a document;

FIG. 16 is an explanatory diagram showing the job table where the data is set by mage write preparation processing applied to the front of recording sheet;

FIG. 17 is an explanatory diagram showing the job table where the data is set by the processing of preparation for image writing into the back of recording sheet;

DETAILED DESCRIPTION OF THE PREFERRED EMBODIMENT

Figure 1:
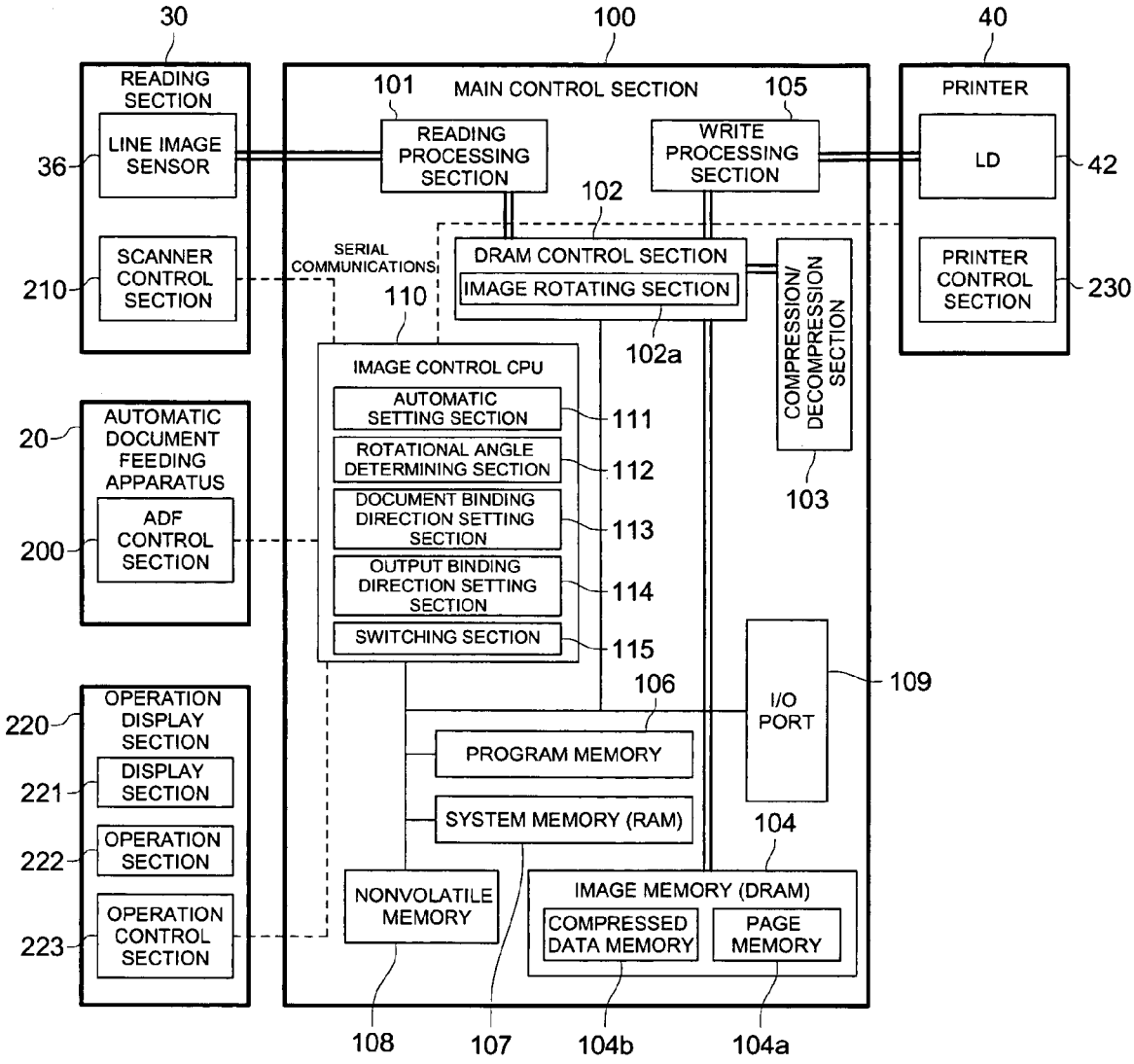
FIG. 1 is a block diagram showing the electrical configuration of a copying apparatus as an embodiment of the present invention.

The aforementioned can be further attained by the following features of the invention.

(11) A copying apparatus equipped with a function of copying a double sided document in duplex printing mode, comprising: a double sided document reading section (20, 30) for reading both sides of a document; a duplex printing section (40) for printing images on both sides of recording sheet; a document binding direction setting section (113, 220) for accepting the setting as to whether the direction for binding the double sided document read by the aforementioned double sided document reading sections (20, 30)—is lateral or vertical with respect to the document image; an automatic setting section (111) for setting whether the output binding direction as the direction of binding the recording sheet when copying a double sided document in duplex printing mode is lateral or vertical with respect to the image printed on the recording sheet, in conjunction with the document binding direction preset by the aforementioned direction setting sections (113, 220); and an image rotating section (image rotator) (102*a*, 112) for applying a required amount of rotation to each of the image read from the front of the double sided document and that read from the back, so that the double sided document having the preset document binding direction can be copied as a printer matter conforming to the preset output binding direction when copying a double sided document in duplex printing mode.

According to the aforementioned configuration (11), when the document binding direction is set, the output binding direction is also set synchronously therewith. In this case, it is also possible to configure the synchronous (automatic) setting mode in such a way that the direction of output binding is automatically set to the same direction as that of document binding. Alternatively, it is also possible to make such arrangements that the synchronous setting mode can be separately set by environment setting or other functions automatically. For example, it is possible to make such arrangements that the output binding direction is automatically set to the direction different from that for document binding. Further, it is also possible to arrange such a configuration that the output binding direction to be set synchronously can be set in advance for each of document binding directions.

"Lateral binding" is defined as a mode of binding either the right or left end with respect to the image on paper. "Vertical binding" is defined as a mode of binding either the upper and lower end with respect to the image on paper. When setting document binding direction, it is possible to accept the specification about the direction of document image and the specification about the side of the document to be bound (long or short side) on a separate basis, and to derive the document binding direction is lateral or vertical with respect to the image, based on these specifications.

Apart from the document binding direction and output binding direction, the image rotating section (102*a*, 112) determines the angle of rotation by referring to various other required parameters. The required parameters include the type of document (portrait or landscape), document setting direction (short edge feed or long edge feed) and recording sheet setting direction (short edge feed or long edge feed).

(12) A copying apparatus equipped with a function of copying a double sided document in duplex printing mode, comprising: a double sided document reading section (20, 30) for reading both sides of a document; a duplex printing section (40) for printing images on both sides of recording sheet; a document binding direction setting section (113, 220) for accepting the setting as to whether the direction for binding the double sided document read by the aforementioned double sided document reading sections (20, 30)—is lateral or vertical with respect to the document image; an output binding direction setting section (114, 220) for accepting the setting as to whether the aforementioned output binding direction is lateral or vertical with respect to the image printed on recording sheet; an automatic setting section (111) for setting whether the output binding direction as the direction of binding the recording sheet when copying a double sided document in duplex printing mode is lateral or vertical with respect to the image printed on the recording sheet, in conjunction with the document binding direction preset by the aforementioned direction setting sections (113, 220); and an image rotating section (102*a*, 112) for applying a required amount of rotation to each of the image read from the front of the double sided document and that read from the back, so that the double sided document having the preset document binding direction can be copied as a printer matter conforming to the preset output binding direction when copying a double sided document in duplex printing mode. Further, this copying apparatus allows the output binding direction to be set from both the aforementioned automatic setting section (111) and output binding direction setting section (114, 220).

According to the aforementioned configuration (12), the output binding direction is set by the automatic setting section (111) allows a user to set the output binding direction to a desired one through the output binding direction setting section (114, 220). For example, it is preferred to arrange such a configuration that the output binding direction be automatically set by the automatic setting section (111) when the document binding direction has been set; then the user change the output binding direction through the output binding direction setting section (114, 220). Here the user sets the output binding direction only when required. This arrangement reduces the load in operation of setting the direction of binding, while meeting various combinations of the binding directions.

(13) A copying apparatus described in configuration (11) or (12) wherein the aforementioned automatic setting section (111) determines the setting so that the output binding direction is the same as the document binding direction.

When duplex copying is performed, identically the same copy as the original document including the binding direction is often created. In such a case, use of automatic setting function ensures an effective reduction of operation loads.

(14) A copying apparatus described in configuration (11), (12) or (13) further comprising a switching function of selecting whether or not the output binding direction should be set by the automatic setting section (111) when copying a double sided document in duplex printing mode.

According to configuration (14), it is possible to select whether or not the output binding direction should be automatically set by the automatic setting section (111). The on-off switching of the automatic setting function should be performed by the manager mode. It is also possible to arrange such a configuration that on-off switch of the automatic setting function can be set for each user. Further, it is also possible to arrange such a configuration that on-off switch of the automatic setting function can be set for each of such conditions as a document size, document type, document setting direction, recording sheet size and recording sheet setting direction. For example, when an A4 document is used, the output binding direction is automatically set in conjunction with the document binding direction. In the case of an A3 document, however, automatic setting is not performed. Thus, the configuration (4) is capable of meeting a great variety of needs as exemplified above.

(15) A copying apparatus described in configuration (11), (12), (13) or (14) further characterized in that, when the output binding direction is set by the automatic setting section (111), this fact or the output binding direction having been set is notified to the user.

According to the configuration (15), the output binding direction being automatically set by the automatic setting section (111) or the output binding direction having been automatically set is notified to the user. For example, a message or pattern is used to notify the output binding direction. Sound may also be used for this purpose.

In the copying apparatus of the present invention, when the document binding direction has been set, the output binding direction is automatically set in conjunction with the document binding direction. This arrangement reduces the load in the operation of setting the binding direction, hence improves the operability.

When the output binding direction can be set either by the automatic setting section or output binding direction setting section, a user can set the output binding direction as desired. This arrangement reduces the load in operation of setting the direction of binding, while meeting various combinations of the document binding direction and output binding direction.

When the automatic setting section provides settings in such a way that the output binding direction is the same as the document binding direction, this arrangement ensures an effective reduction in the load of the operation involved in setting the direction of binding, because identically the same copy as the original document including the binding direction is often created in duplex copying.

When there is a switching function of selecting whether or not the output binding direction should be automatically set by the automatic setting section, duplex copying in the output binding direction not desired by the user can be prevented by turning off the automatic setting.

When the capability of the output binding direction being automatically set by the automatic setting section or the automatically set output binding direction is notified to the user, the user is allowed to check the output binding direction before outputting. This arrangement avoids the error of being copied in the output binding direction not intended by the user.

Preferred Embodiment

Figure 2:
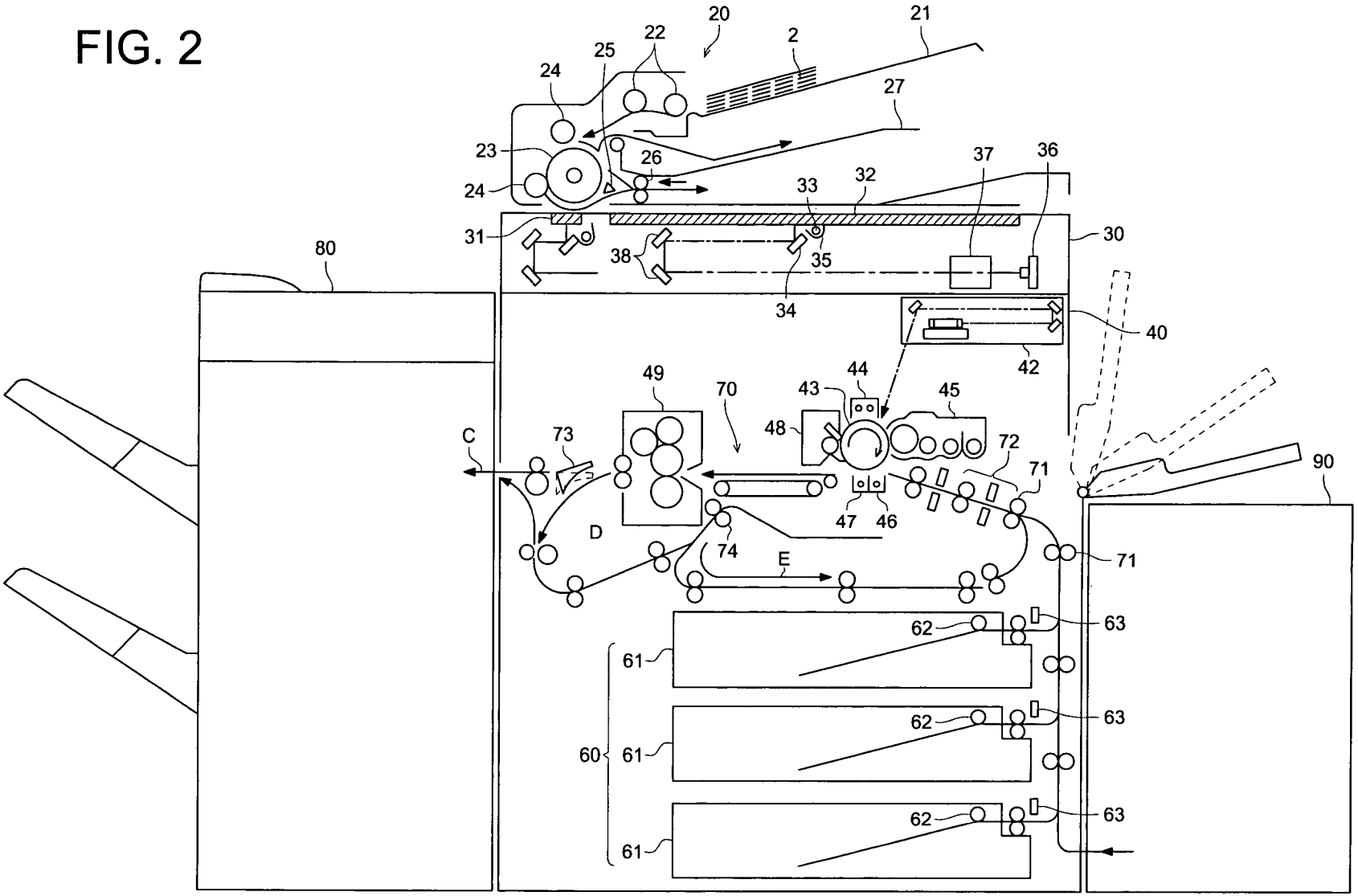
FIG. 2 is an explanatory diagram representing the sectional configuration of a copying apparatus as an embodiment of the present invention.

The following describes the preferred embodiments of the present invention with reference to drawings:

FIG. 2 is an explanatory diagram representing the sectional configuration of a copying apparatus 10 as an embodiment of the present invention. The copying apparatus 10 is a digital copying machine, and is equipped with the so-called duplex copying function to form the corresponding image on the front and back of recording sheet. Further, the direction of binding the document (document binding direction) and the direction of binding the recording sheet to be outputted and printed (output binding direction) can be set by a user. The copying apparatus 10 also has an automatic setting function to automatically set the output binding direction in conjunction with the document binding direction. Referring to the preset binding direction and other required parameters, the copying apparatus 10 rotates each of the front and back images captured from the document by a required angle in such a way that the image to be printed on the recording sheet will be oriented in conformance to the preset output binding direction, whereby printing is carried out.

Such a copying apparatus 10 consists of an automatic document feeding apparatus 20, reading section 30, printing section 40, post-processing apparatus 80 and large-capacity paper supply tray 90. The automatic document feeding apparatus 20 (hereinafter referred to as "ADF") feeds the documents 2 loaded on a document tray 21 one by one to the reading head of the reading section 30. It is also equipped with a reversing mechanism. When handing a double sided document, it reverses the paper after reading one side, and feeds it to the reading section 30 again. The function as a double sided document reading means for reading both the front and back of the document is performed by the automatic document feeding apparatus 20 and reading section 30.

The automatic document feeding apparatus 20 consists of a paper supply roller 22 for feeding the documents loaded on the document tray 21 one by one from the top topmost sheet; a contact roller 23 for feeding the document through the contact glass 31 as a reading head of the document while contacting the document thereto; and a guide roller 24 for guiding the document fed by the paper supply roller 22, along the contact roller 23. It also contains a switching claw 25 for switching the direction of the document having passed through the contact glass 31, a reversing roller 26 for reversing the front and back of the double sided document and an ejection tray 27 for ejecting the document that has been read.

A double sided document is guided by the switching claw 25 so as to pass between a pair of reversing rollers 26 after having passed through the contact glass 31 fed to the contact roller 23. Immediately before the trailing edge of the document reaches the reversing roller 26, the direction of the reversing roller 26 is reversed and the position of the switching claw 25 is changed. The document is then fed out toward the position above the contact roller 23. This reverses the document position.

Having been fed to the contact roller 23 and having passed again over the contact glass 31, the document is reversed again, and is guided by the switching claw 25 toward the ejection tray 27 to be rejected thereafter. In the case of a single sided document, it is fed out of the document tray 21 to pass over the contact glass 31 along the contact roller 23, and is guided to the ejection tray 27, where the document is ejected.

The reading section 30 comprises a slit-like contact glass 31 as a reading head of the document fed by the automatic document feeding apparatus 20, and a platen glass 32 loaded with the document. An exposure scanning section 35 consisting of a light source 33 and a mirror 34 is located below the contact glass 31 and platen glass 32. The exposure scanning section 35 is designed to be movable along the lower surface of the platen glass 32 by a drive means (not illustrated). The light source 3 applies light to the document through the contact glass 31 and platen glass 32. Receiving the light reflected from the document, the platen glass 32 adjusts the path to be in parallel with the platen glass 32.

The reading section 30 is composed of a line image sensor 36 that receives the light reflected from the document and outputs the electrical signal in response to its light intensity, a condensing lens 37 concentrate the light reflected from the document into the line image sensor 36, and various types of mirror 38 for forming an optical path that leads the light reflected from the mirror 34 of the exposure scanning section 35, to the line image sensor 36. The line image sensor 36 scans the document in the direction of main scanning, and is composed of many CCDs.

When the automatic document feeding apparatus 20 is used, the document is read by the read-through method. According to this method, the exposure scanning section 35 is stopped immediately below the contact glass 31, and sub-scanning is performed by moving the document so as to pass on the contact glass 31, whereby the document is read. The document 2 set on the document tray 21 of the automatic document feeding apparatus 20 with the front side facing upward is pulled in by the paper supply roller 22 from the left edge, and is then reversed and fed along the contact roller 23, thereby passing through the reading head on the contact glass 31. To be more specific, the reading head moves to as to cross the document from left to right, when the document setting status is viewed from the stop, whereby the document is read.

The printing section 40 as a duplex printing means forms an image conforming to the image data on the recording sheet (recording member) by the electrophotographic process. The printing section 40 has a laser unit 42 for outputting laser beams that turn on and off in response to the image data. The laser unit 42 has a laser diode, a polygon mirror, various types of lens and mirrors. The printer 40 includes a photoconductor 43 as an electrostatic latent image carrier with an electrostatic latent image formed on the surface, a charging device 44 installed around it, a developing device 45, a transfer device 46, separating device 47 and cleaning device 48.

The photoconductor 43 is a cylindrical body rotated in a predetermined direction (marked "A" in the drawing) by a drive section (not illustrated). The charging device 44 electrically charges the photoconductor 43 uniformly through corona discharge. The surface of the photoconductor 43 uniformly charged in this manner is scanned by laser beams that turns on and off in response to image data, whereby an electrostatic latent image is formed on the surface of the photoconductor 43. The electrostatic latent image formed on the surface of the photoconductor 43 is made into a visible image by the developing device 45 using toner.

The transfer device 46 transfers the toner image on the surface of the photoconductor 43, onto the recording sheet by applying an electric field thereto. The separating device 47 separates the recording sheet from the photoconductor 43 by electric charge elimination. The cleaning device 48 uses a blade to rub the toner remaining on the photoconductor 43 to remove and recover it. The recovered toner is returned to the developing device 45 through the path (not illustrated).

The printer 40 incorporates a paper supply section 60 for supplying the recording sheet, a recording sheet transport section 70 for transporting the supplied recording sheet so as to pass it through the transfer position between the photoconductor 43 and transfer device 46, and a fixing apparatus 49 for pressuring and heating the toner image formed on the recording sheet, thereby fixing the tone imager on the recording sheet surface. The paper supply section 60 has a plurality of paper supply cassettes 61, which normally accommodate recording sheet having different sizes and types.

A first paper supply roller 62 for feeding each sheet of the recording sheet of the topmost layer stored in the paper supply cassette 61, to the recording sheet transport section 70 is installed in the vicinity of the outlet of each of the paper supply cassettes 61. A tray outlet sensor 63 for detecting the recording sheet having been fed out is located at the outlet of each of the paper supply cassettes 61. The recording sheet transport section 70 is provided with many transporting rollers 71 at an interval smaller than the size of the minimum sized recording sheet in the feed direction. A second paper supply section 72 consisting of a sensor for detecting the recording sheet and a second paper supply roller is arranged just short of the transfer position between the photoconductor 43 and transfer device 46 of the recording sheet transport section 70.

A path switching claw 73 for switching the path of the recording sheet is arranged on the back (downstream) of the fixing apparatus 49. When the path switching claw 73 is positioned at the horizontal position shown by the dotted line in the figure, the recording sheet having been fixed is ejected to a post-processing apparatus 80. When the path switching claw 73 is set to the included position showed by the solid line in the figure, the recording sheet advances in the direction marked with D. After the paper has been reversed, it gets back to the original path upstream from the second paper supply section 72, whereby recording is performed on the back.

Recording sheet is reversed as follows: The recording sheet fed from the fixing apparatus 49 in the direction marked with D advances so as to pass through a pair of reversing rollers 74. Rotation of the reversing rollers 74 is reversed immediately before the trailing edge of the recording sheet reaches the reversing rollers 74, and the paper is transported in the direction marked with E, different from the previous direction, whereby the paper is reversed.

The post-processing apparatus 80 bundles a plurality of recording sheet sheets and stitches them by a stapler, or punches a hole through them.

FIG. 1 is a block diagram showing the electrical configuration of the copying apparatus (10). The automatic document feeding apparatus 20 has an ADF control section 200. The reading section 30 contains a line image sensor 36 and a scanner control section 210. The scanner control section 210 controls lighting of the light source 33 and the movement of the exposure scanning section 35.

The operation display section 220 receives various operations by a user and displays various information items for the user. The operation display section 220 includes a display section 221 consisting of a liquid crystal display, an operation section 222 consisting of touch switches and other switches arranged on the screen, and an operation control section 223 for controlling the display section 221 and operation section 222.

The printer 40 contains a laser unit 42 and a printer control section 230. The printer control section 230 provides on/of control of the laser diode of the laser unit 42 and rotation control of the polygon mirror. Further, the printer control section 230 integrally controls application of voltage to the charging device 44, transfer device 46 and separating device 47, rotation of the photoconductor 43, and operations of the developing device 45, cleaning device 48, fixing apparatus 49, paper supply section 60 and recording sheet transport section 70.

The ADF control section 200, scanner control section 210, operation control section 223 and printer control section 230 are each composed of a circuit mainly consisting of a CPU, ROM and RAM. They provide various controls according to the program stored in the ROM.

The main control section 100 integrally controls the operations of the copying apparatus 10. The main control section 100 comprises a reading processing section 101, DRAM control section 102, compression/decompression section 103, image memory 104, write processing section 105, image control CPU 110, program memory 106, system memory 107, nonvolatile memory 108 and I/O port 109.

The reading processing section 101 applies processing of enlargement and mirror imaging, and binary processing by error diffusion to the image data outputted by the reading section 30. The compression/decompression section 103 compresses the binarized image data and decompresses the once compressed data. The compression/decompression section 103 is capable of parallel and independent compression and decompression. The image memory 104 performs the function as a page memory 104*a* capable of storing the non-compressed image data in units of page and the function as a compressed data memory 104*b* for storing the compressed image data.

The write processing section 105 sends the image data, read from the image memory 104 and decompressed thereafter, to the laser unit 42 at timed intervals conforming to the operation of the printer 40. The DRAM control section 102 controls the read/write and refresh timing with respect to the image memory 104 consisting of a dynamic RAM. It also controls the timing of compressing the image data and storing it in the image memory 104, and reading the compressed data from the image memory 104 and decompressing it.

The DRAM control section 102 performs the functions of the image rotating section 102*a* that rotates an image. The image is rotated when the image data is read out of the image memory 104 and is set to the printer 40. To put it in greater details, after one page of the image data decompressed by the compression/decompression section 103 has been loaded into the page memory 104*a*, the image is read out of this page memory 104*a* in the order different from the order in which the image data is loaded, and is sent to the printing section, whereby the image is rotated.

The image control CPU 110 performs the function of control means for controlling the entire operation of the copying apparatus 10. The image control CPU 110 also controls the image data flow and performs the functions of the automatic setting section 111 and image rotating section 112. It also cooperate with the operation control section 223 to perform the function of the direction setting section 113, output binding direction setting section 114 and switching section 115.

The direction setting section 113 performs the function of internal registration by receiving the information on the setting of the direction of binding of the double sided document (document binding direction) set by the automatic document feeding apparatus 20 as to whether lateral binding or vertical binding should be used with respect to the document image. The output binding direction setting section 114 performs internal registration by receiving the information on the setting as to whether lateral binding or vertical binding is used with respect to the image printed on the recording sheet.

When copying a double sided document in duplex printing mode, the automatic setting section 111 automatically sets whether the output binding direction as the direction of binding the recording sheet should be the direction of lateral binding or the direction of vertical binding with respect to the image printed on the recording sheet, in conjunction with the document binding direction of the double sided document. The output binding direction setting section 114 switches the setting by receiving the information on the switching of setting as to whether automatic setting by the automatic setting section 111 should be performed or not. The image rotating section 112 determines the rotational angle for each image, based on the direction of binding the document and recording sheet, type of the document, document setting direction, document size, recording sheet size and other information.

The program memory 106 stores the program executed by the image control CPU 110. The system memory 107 is a work memory for various data items on a temporary basis during the execution of the program. The nonvolatile memory 108 stores the user data and system data that should be stored even after the power has been turned off. The I/O port 109 is connected with various sensors and LEDs.

Figure 3:
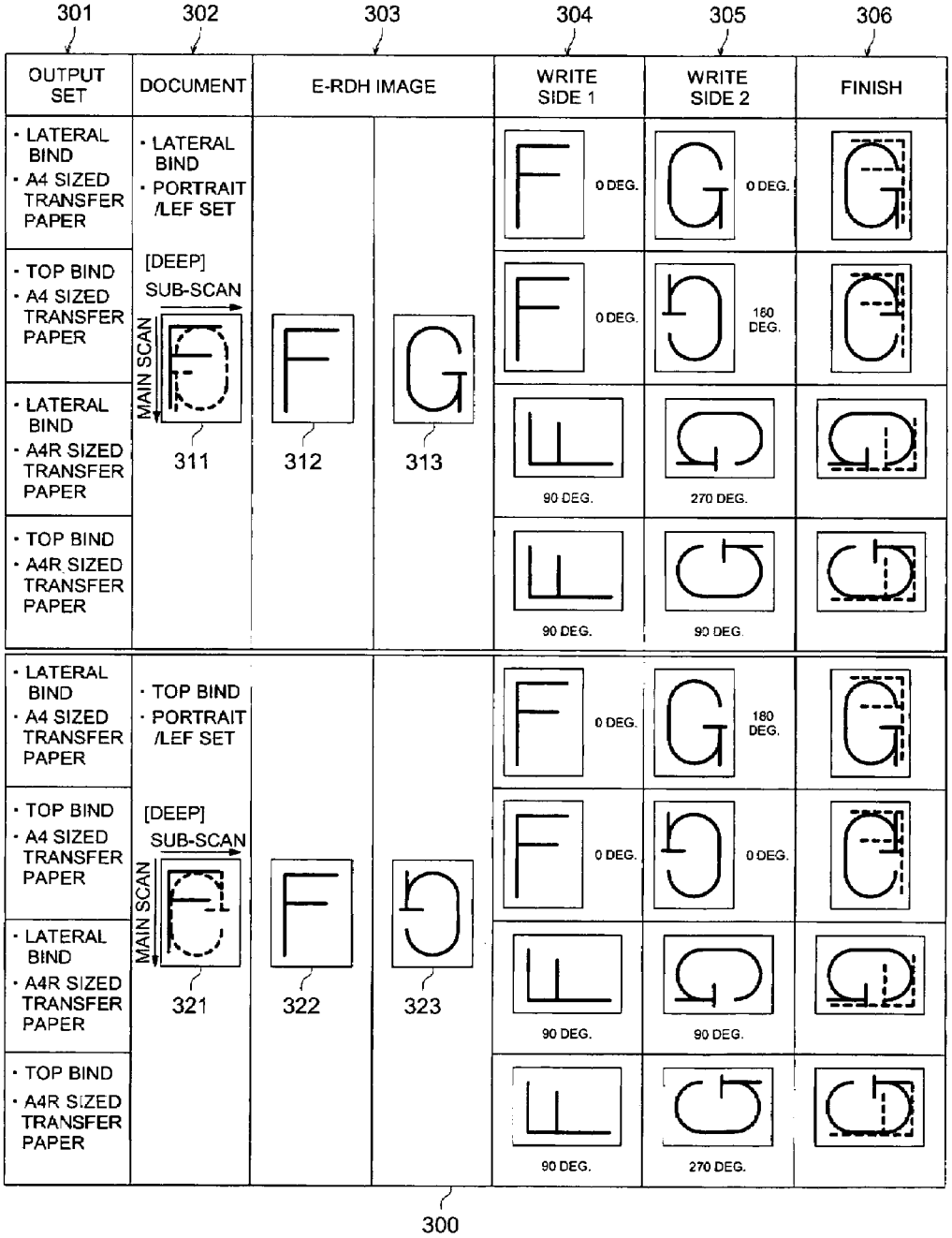
FIG. 3 is an explanatory diagram representing an example of relationship between the combination of the document binding direction and output binding direction, and the rotational angle of an image.

FIG. 3 shows an example of relationship between the combination of the document binding direction and output binding direction, and the rotational angle of an image. A rotational angle list 300 shows the case where the document is of portrait type, and the document is set on the document tray 21 in a normal setting mode. Normal setting refers to the mode of setting the document in such a direction that the top of the image is located in the deeper portion of the document tray 21, and the paper is fed in the direction of LEF (long edge feed), wherein the long side of the paper is the leading edge of the paper being fed. Incidentally, the SEF (short edge feed) direction is the direction where paper is fed in such a way that the short side is the leading of the paper.

In FIG. 3, "Output setting" column 301 includes the output binding direction as the direction of binding the printed recording sheet, recording sheet setting direction and recording sheet size. "A4 recording sheet" denotes that the recording sheet has an A4 size and the recording sheet is set in the LEF direction. "A4R recording sheet" denotes that the recording sheet has an A4 size and the recording sheet is set in the SEF direction. The "Document" column 302 shows the direction of binding the document set on the document tray 21, document type and document setting direction.

The "E-RDH image" column 303 shows the image captured by the reading section 30. The left side of the "E-RDH image" column 303 represents the image of the front surface of the document, while the right side shows the image of the back surface. The "SIDE 1 Write" column 304 shows the image to be fed to the laser unit 42 of the printer 40 when printing on the front of the recording sheet. The "SIDE 2 Write" column 305 shows the image to be fed to the laser unit 42 of the printer 40 when printing on the back of the recording sheet. The "Finish" column 306 shows the recording sheet having been printed on both sides. It shows the case where the recording sheet ejected reversely in such a way that the front surface faces downward is viewed from above the ejection tray. In the figure, characters in broken lines indicate those printed on the back of the paper are viewed through the front side.

When the document is bound in the lateral direction, the document front image (F) and back image (G) are in the same direction, as shown in documents 311 through 313 in the figure. When the document is bound in the lateral direction and output setting is in the mode of "Lateral binding, A4 size", the rotational angles of the document front image (F) and back image (G) are zero degree, as shown in the top row of the figure. When the document is bound in the lateral direction and output setting is in the mode of "Top binding, A4 size", the rotational angles of the document front image (F) is zero and that of the back image (G) is 180 degrees, as shown in the second row of the figure. This arrangement ensures an erect image on the back when the top-bound page is turned over.

When the document is bound in the lateral direction and output setting is in the mode of "Lateral binding, A4R size", the rotational angles of the document front image (F) is 90 degrees and that of the back image (G) is 270 degrees, as shown in the third row of the figure. Since the output binding direction is lateral, the front image and back image should be oriented in the same manner originally. However, if the recording sheet is fed in the SEL direction, the recording sheet feed direction at the time of back printing will be reversed 180 degrees with respect to that at the time of front printing. To offset this difference, the rotational angles of the front and back are obtained by adding 180 degrees to the original value. For the same reason, when the document is bound in the lateral direction and output setting is in the mode of "Top binding, A4R size", the rotational angles of the document front image (F) is 90 degrees and that of the back image (G) is 90 degrees, as shown in the fourth row of the figure.

When "Top binding" is applied to the document, the direction of back image (G) is turned 180 degrees with respect to the document front image (F), as shown in document 321 through 323. Thus, the rotational angle of the back image (G) is the value obtained by adding 180 degrees to the value in the case of "Lateral binding" applied to the document. To be more specific, when "Top binding" is applied to the document and output setting is in the mode of "Lateral binding, A4 size", the rotational angle of the document front image (F) is zero degree, and that of the back image (G) is 180 degrees, as shown in the fifth row of the figure.

When "Top binding" is applied to the document and output setting is in the mode of "Top binding, A4 size", the rotational angles of both the document front image (F) and back image (G) are zero degree, as shown in the sixth row of the figure. When "Top binding" is applied to the document and output setting is in the mode of "Lateral binding, A4R size", the rotational angles of both the document front image (F) and back image (G) are 90 degree, as shown in the seventh row of the figure.

When "Top binding" is applied to the document and output setting is in the mode of "Top binding, A4R size", the rotational angle of the document front image (F) is 90 degrees and that of the back image (G) is 270 degrees, as shown in the bottom row of the figure.

When the document is of portrait type and is set in the SEF direction, when the document is of landscape type and is set in the LEF direction and when the document is of landscape type and is set in the SEF direction, required angles of rotations are determined in advance with respect to various combinations of the output setting and document binding direction, similarly to the case shown in FIG. 3. Their illustration and description will be omitted to avoid duplication.

Figure 4:
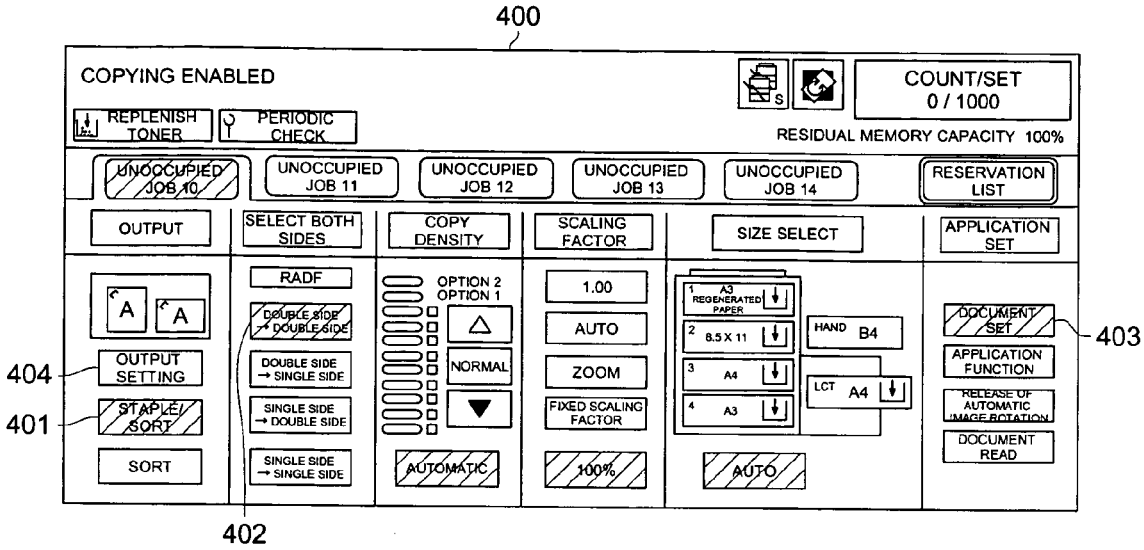
FIG. 4 is a front view representing an example of the basic screen displayed on a copying apparatus as an embodiment of the present invention.
Figure 5:
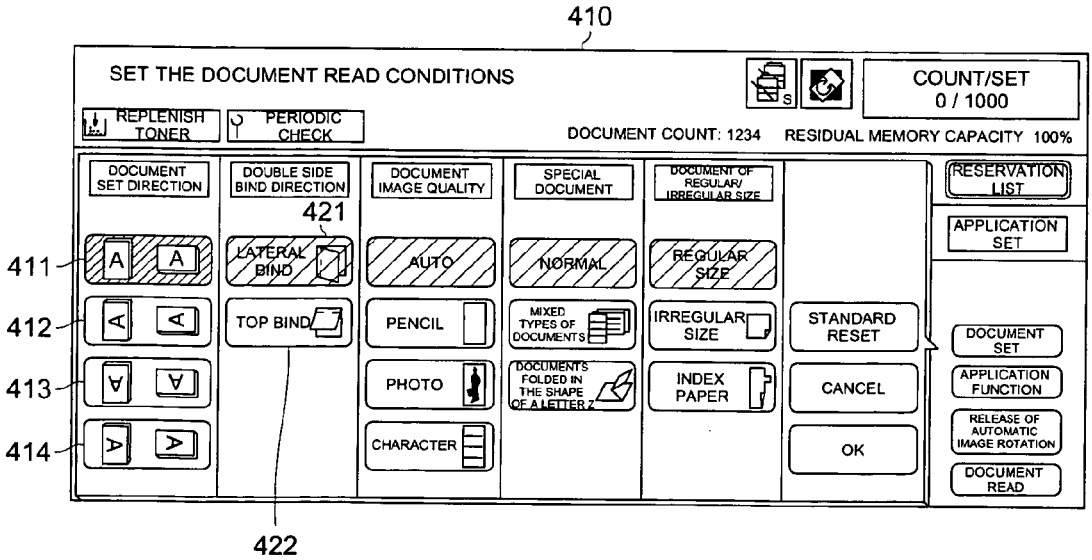
FIG. 5 is a front view representing the document setting screen displayed on a copying apparatus as an embodiment of the present invention.

The following describes the automatic setting function for automatically setting the output binding direction in conjunction with the setting of document binding direction: FIGS. 4 and 5 show the transition of the screen when setting the direction of setting the documents placed in the document tray 21 and the direction of binding the documents. FIG. 4 shows an example of the basic screen 400 when performing the copying operation. The basic screen 400 includes various characters and patterns as well as various operation buttons for changing settings.

The operation buttons marked with oblique lines indicate that the related settings have been selected. In FIG. 4, a "Staple Sort" button 401 is selected. It indicates that the recording sheet to be printed and outputted should be bound by the post-processing apparatus 80. Further, a "Double Side→Double Side" button 402 is selected. This shows that the double sided document should be copied in the duplex printing mode.

On the basic screen 400, when the "Document setting" button 403 has been pressed, the displayed screen is switched over to the Document setting screen 410 shown in FIG. 5. In the initial state, the document setting direction is the same as that selected by the erect image button 411. By operating one of the erect image button 411, left orient button 412 and inverted image button 413, the user can set a definition in such a way that the document is set in the corresponding direction.

The document setting direction corresponding to the erect image button 411 refers to the cases where the portrait document is set in the normal direction (where the top of the image is located in the deeper portion of the document tray 21) and is fed in the LEF direction, and where the landscape document is set in the normal direction and is fed in the SEF direction. The document setting direction corresponding to the left orient button 412 refers to the cases where the portrait document is set at an angle of 90 degrees, (where the top of the image is located on the left of the document tray 21) and is fed in the SEF direction, and where the landscape document is set an angle of 90 degrees and is fed in the LEF direction.

The document setting direction corresponding to the inverted image button 411 refers to the cases where the portrait document is set at an angle of 180 degrees (where the top of the image is located in the front position of the document tray 21) and is fed in the LEF direction, and where the landscape document is set at an angle of 180 degrees and is fed in the SEF direction. The document setting direction corresponding to the right orient button 414 refers to the cases where the portrait document is set at an angle of 270 degrees, (where the top of the image is located on the right of the document tray 21) and is fed in the SEF direction, and where the landscape document is set an angle of 270 degrees and is fed in the LEF direction.

The document setting screen 410 is provided with a lateral bind button 421 and top bind button 422 for setting the document binding direction. When the automatic setting function is turned on to provide automatic setting of the output binding direction in conjunction with the setting of the document binding direction, the output binding direction can be set automatically by operating the lateral bind button 421 or top bind button 422.

To put it more specifically, the copying apparatus 10 creates a set data registration table 430 for each job as shown in FIG. 6. This set data registration table 430 registers the contents of various set items related to job execution. When the document binding direction has been set, the binding direction is set in the "document binding direction" column of the set data registration table 430. If the automatic setting function is on, the same binding direction as the document binding direction is automatically set in the "output binding direction" column 432. It is also possible to arrange such a configuration that a message or pattern is arranged on the top display column of the document setting screen 410 to show the automatically set output binding direction.

Figure 7:
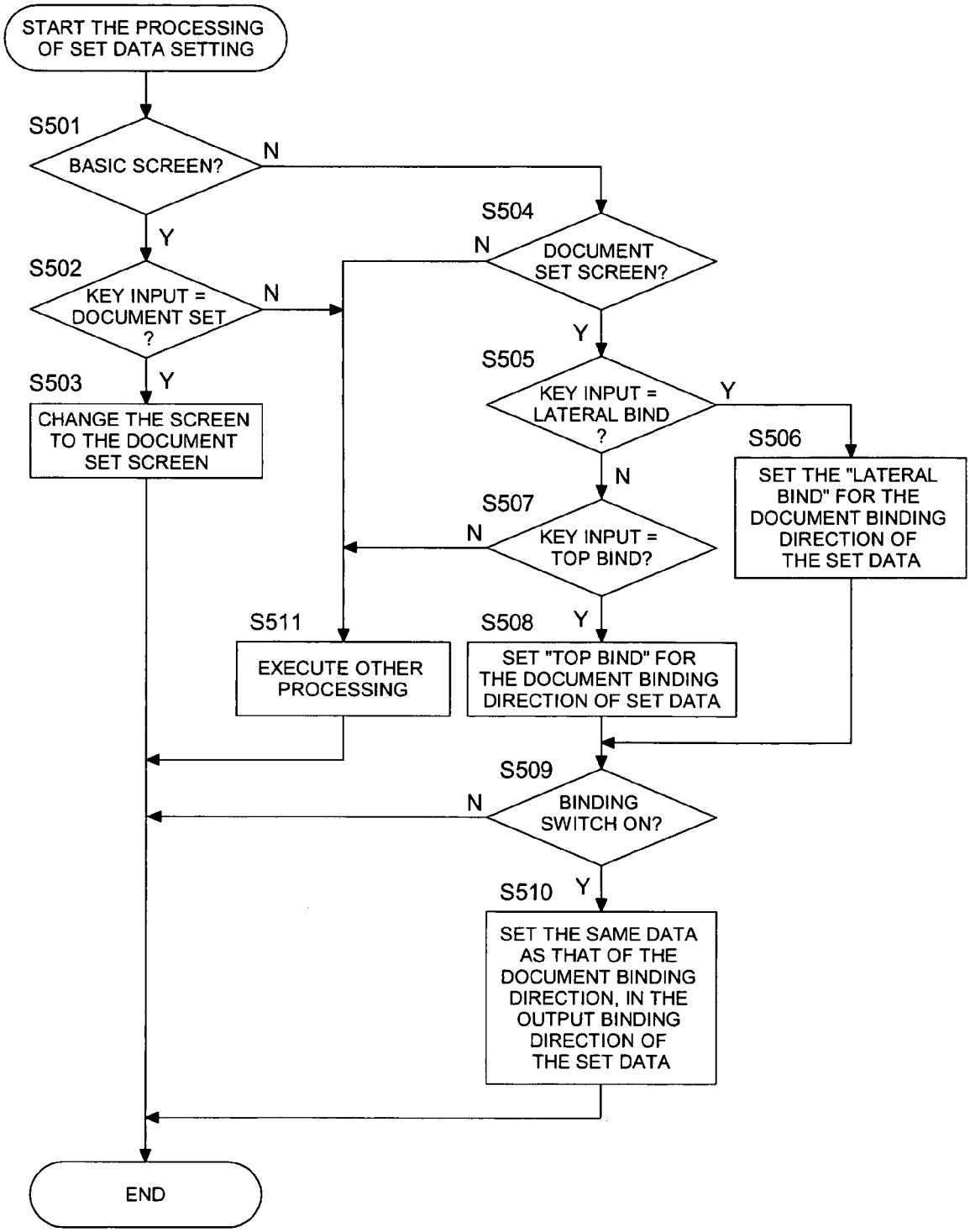
FIG. 7 is a flowchart showing the processing of set data setting applied by a copying apparatus as an embodiment of the present invention.
Figure 8:
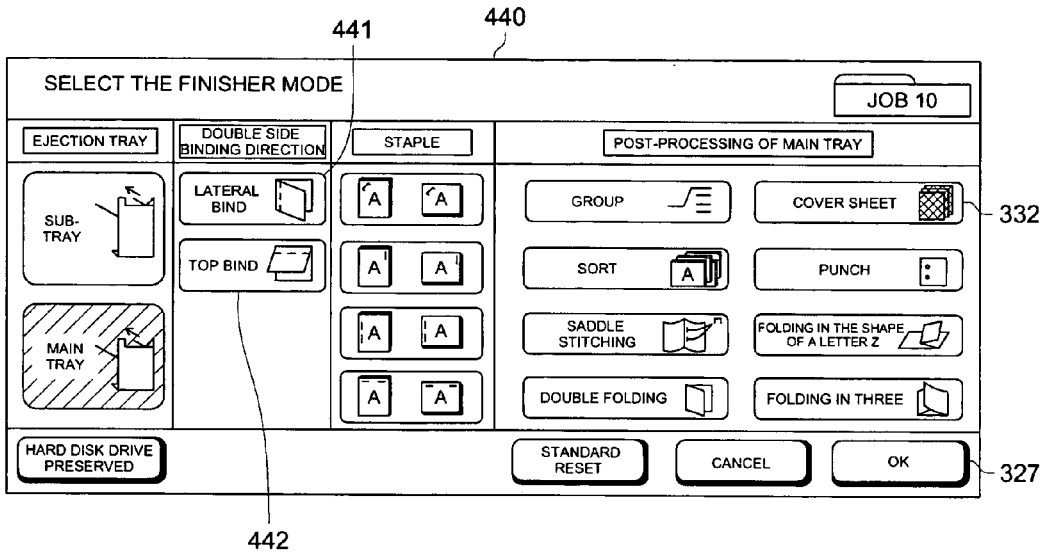
FIG. 8 is a front view showing an example of the output setting screen displayed on a copying apparatus as an embodiment of the present invention.

FIG. 7 shows the flow of set data setting processing for registering the contents of various settings in the set data registration table 430. The screen shown on the display section 221 indicates the basic screen 400 (Step S501: Y). When the "Document setting" button 403 has been pressed (Step S502: Y), the screen to be displayed is changed to the document setting screen 410 (Step S503). "Lateral bind" is registered in the is registered in the "document binding direction" column 431 of the set data registration table 430 (Step S506) by operating the lateral bind button 421 (Step S505: Y) when the document setting screen 410 is being displayed (Step S501: N, Step S504: Y). If the top bind button 422 is operated (Step S507: Y), "Top bind" is registered in the "document binding direction" column 431 of the set data registration table 430 (Step S508).

When "Lateral bind" or "Top bind" has been registered in the "document binding direction" column 431 of the set data registration table 430 (Step S506 or S508), a check is made to see if the automatic setting function for automatic setting of the output binding direction in conjunction with the document binding direction is turned on or not (Step S509). If the automatic setting function is on (Step S509: Y), the same binding direction as that in the "document binding direction" column 431 is registered in the "output binding direction" column 432 of the set data registration table 430 (Step S510). When the button other than the "Document setting" button 403 has been operated on the basic screen 400 (Step S502: N), or a button other than the lateral bind button 421 or top bind button 422 on the document setting screen 410 has been operated (Step S504: N or S507; N), then other relevant processing will be applied (Step S511).

The following describes the case where the output binding direction is set by the user: If the user has operated the output setting button 404 on the basic screen 400 shown in FIG. 4, the output setting screen 440 appears on the display section 221. If the user has operated the "Lateral bind" button 441 on the output setting screen 440, the "Lateral bind" is set in the "output binding direction" column 432 of the set data registration table 430. If the user has operated the "Top bind" button 442 on the output setting screen 440, the "Top bind" is set in the "output binding direction" column 432 of the set data registration table 430.

In other words, if the user does not operate the "Lateral bind" button 441 or "Top bind" button 442 of the output setting screen 440, the output binding direction set by the automatic setting function remains valid. If the use operates the "Lateral bind" button 441 or "Top bind" button 442 of the output setting screen 440, the output binding direction selected by the user is set in preference to the setting of the automatic setting function.

It is preferred to make such arrangements that, if the document binding direction is set on the document setting screen 410 after the output binding direction has been set on the output setting screen 440, preference is given to the setting by the user on the output setting screen 440, and the automatic setting function is disabled. It is also possible to make such arrangements that priority is given to the later setting so that the setting by automatic setting function is enabled even if the document binding direction is set on the document setting screen 410 after the output binding direction is set on the output setting screen 440.

Figure 9:
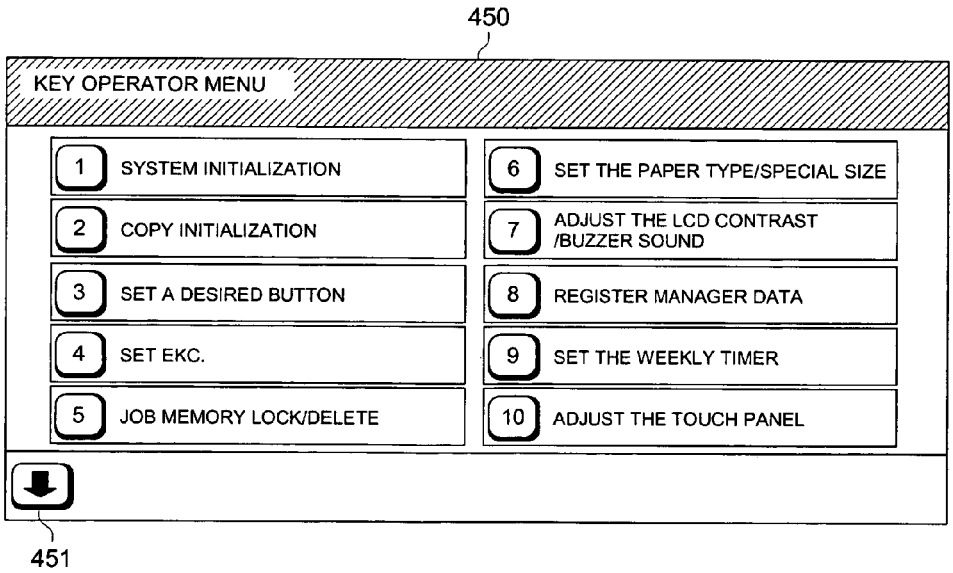
FIG. 9 is a front view showing an example of the "Key operator menu" screen displayed on a copying apparatus as an embodiment of the present invention.
Figure 10:
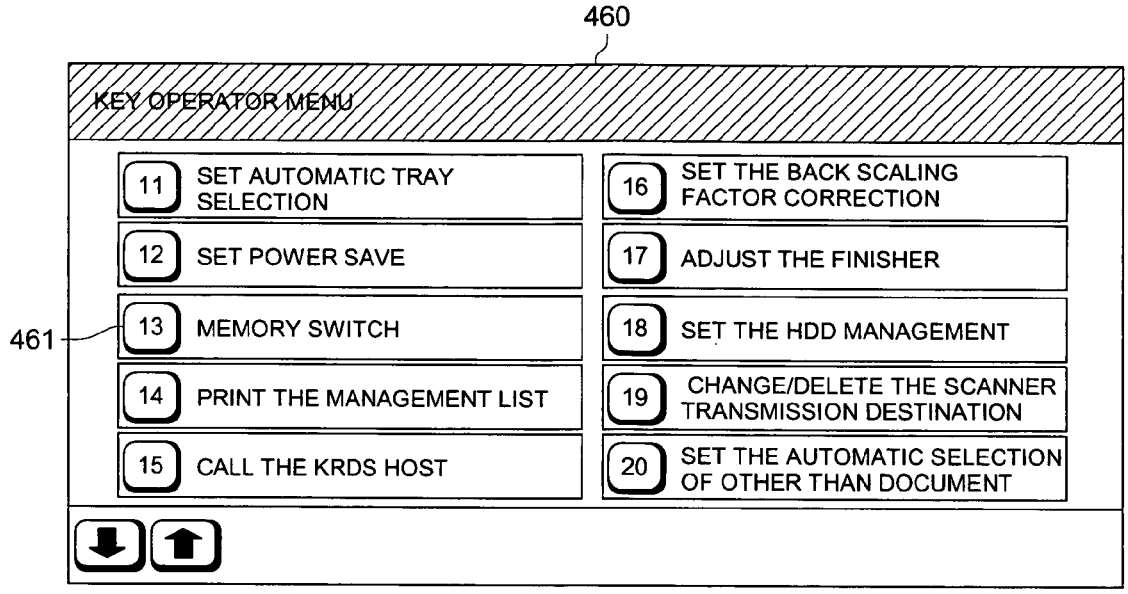
FIG. 10 is a front view showing another example of the "Key operator menu" screen.
Figure 11:
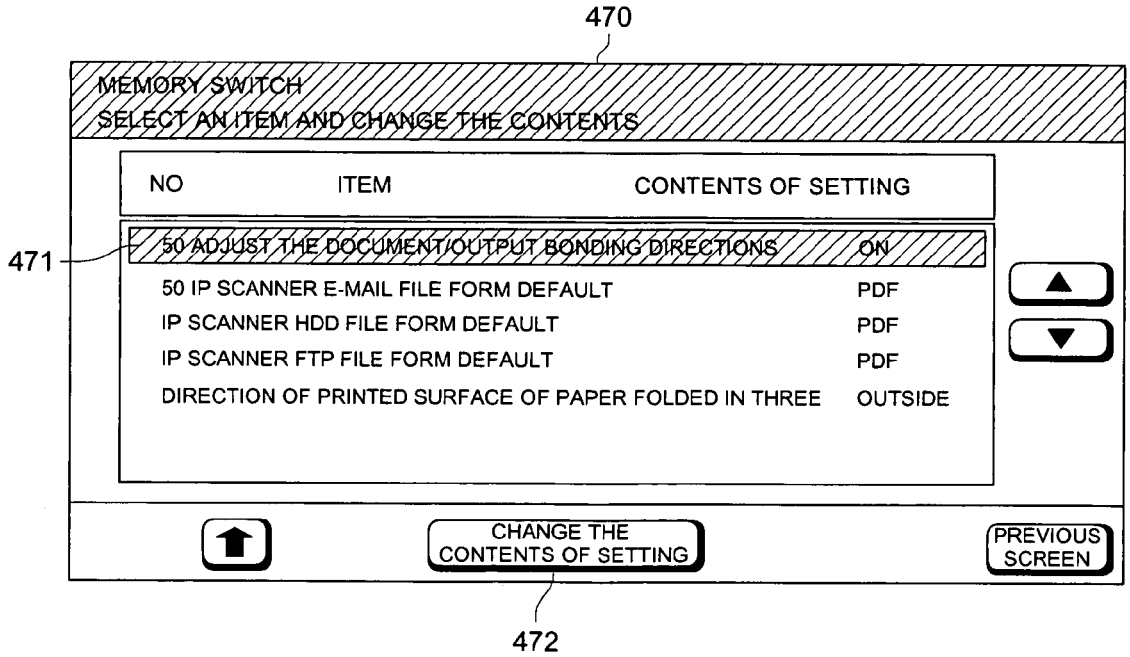
FIG. 11 is a front view showing an example of memory switch detailed setting screen displayed on a copying apparatus as an embodiment of the present invention.

The following describes the on-off switching function of the automatic setting function: In the present example, whether the automatic setting function should be turned on or off is selected by switching in the manager mode. FIGS. 9 through 11 show the transition of the screens related to the on-off switching operation of the automatic setting function. FIG. 9 shows the "key operator menu" screen 450 that appears by performing a special operation to get into the manager mode. Ten items whose settings can be changed by the manager are listed on this screen 450. When the manager has selected any item, the detailed setting screen for that item appears, so that the settings of the default status or initial value of each item can be changed.

If the down arrow button 415 on the "key operator menu" screen 450 has been operated, the key operator menu screen 460 listing ten items appears, as shown in FIG. 10. In the present example, when the 13th memory switch button 461 displayed on the key operator menu screen 460 has been selected, the memory switch detailed setting screen 470 is displayed. After the "No. 50" item column 471 has been displayed by scrolling the page up or down, this item column 471 is selected, and the set content change button 472 is pressed. This procedure switches the on-off operation of the automatic setting function.

If the automatic setting function is set to the OFF position, (N) is chosen in Step S509 of FIG. 7, and the same direction as the document binding direction will not be automatically set to the output binding direction.

The following describes the duplex copying operation where a double sided document is copied in duplex printing mode. The duplex copying operation is achieved by a combination of the following two steps: a document reading operation step where a document image is read compressed and stored in the compressed data memory 104*a* and an image write operation step where the compressed image data is read from the compressed data memory 104*a* and is decompressed and printed by the printer 40.

In the step of document read operation, the image data flows through the line image sensor 36, reading processing section 101, DRAM control section 102, compression/decompression section 103 (compression), DRAM control section 102 and compressed data memory 104*b*, in that order. When the image is not rotated in the image write operation, the image data is sent through the compressed data memory 104*b*, DRAM control section 102, compression/decompression section 103 (decompression), DRAM control section 102, write processing section 105 and laser unit 42, in that order. When the image data is rotated, it goes through the compressed data memory 104*b*, DRAM control section 102, compression/decompression section 103 (decompression), DRAM control section 102, compressed data memory 104*b* and laser unit 42, in that order.

Figure 12:
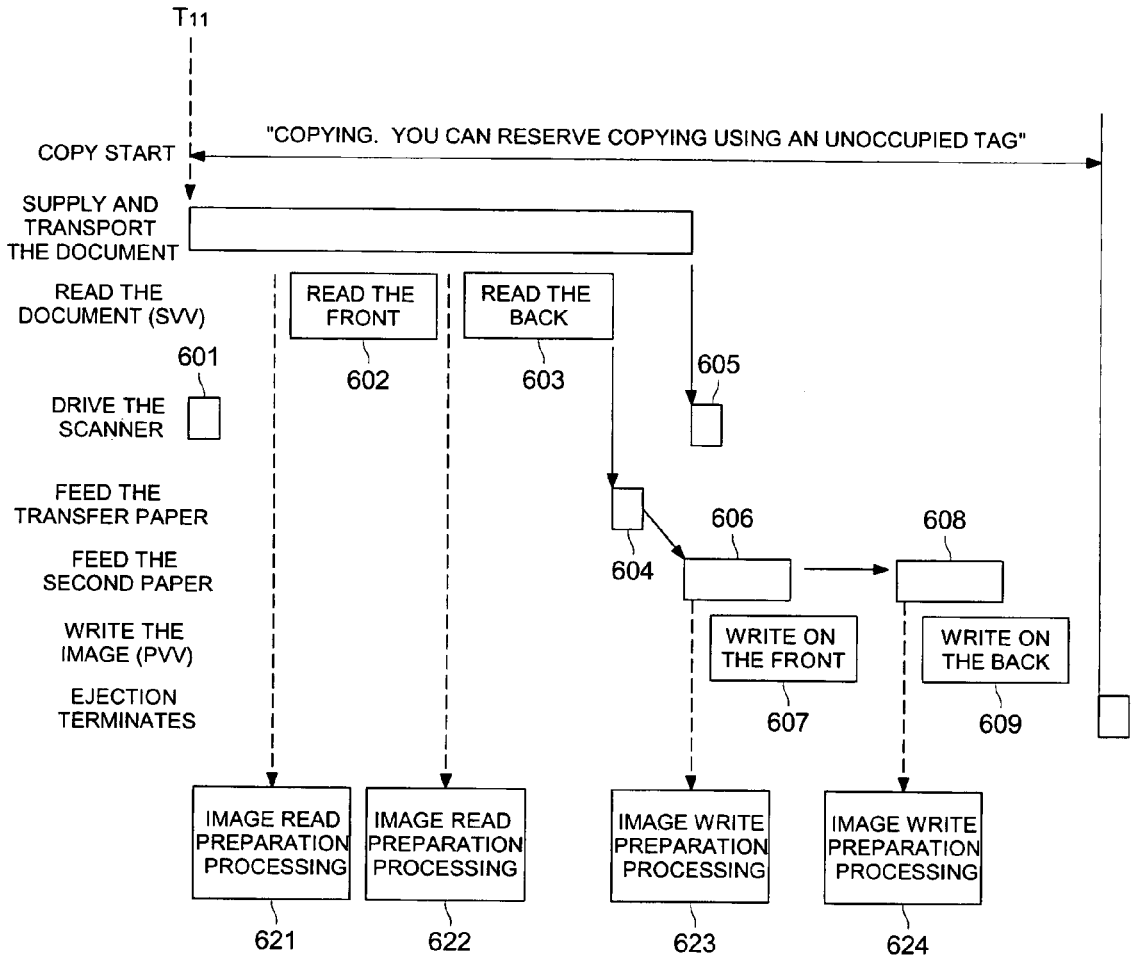
FIG. 12 is an explanatory diagram showing the operation timing of each component in duplex copying.

FIG. 12 shows the operation timing of each component in duplex copying. For the sake of simplicity, FIG. 12 shows the case where both the front and back of a document is read and the images are printed on both sides of one sheet of recording sheet to be outputted. If the copy start button (not illustrated) is pressed at the time of day T11, the document transport is started by the automatic document feeding apparatus 20. At the time of scanner drive operation 601 is started by the scanner control section 210, and the exposure scanning section 35 is fed to the reading position immediately below the contact glass 31.

Then document read operation 602 is applied to the front of the document in conjunction with the SVV (Scanner Vertical Valid) signal sent from the scanner control section 210 or ADF control section 200 to the DRAM control section 102. Further, the document is reversed by the reversing mechanism of the automatic document feeding apparatus 20, and the document read operation 603 is applied to the back of the document in conjunction with the next SVV signal.

Upon completion of the document read operation 603 applied to the back of the document, the recording sheet feed-out operation 604 starts. Scanner drive operation 605 is performed to return the exposure scanning section 35 to the home position. When the image data to be printed has been all prepared, second paper supply feed-out operation 606 can be performed, whereby the recording sheet having reached the second paper supply section 72 is sent to the next path. After start of the second paper supply feed-out operation 606, image write operation 607 is applied to the front of the recording sheet in conjunction with the PVV (Printer Vertical Valid) signal sent from the printer 40 to the DRAM control section 102.

After that, recording sheet is reversed through the fixing apparatus 49, path D, reversing rollers 74 and path E. Then it goes back to the second paper supply section 72. If the image data for the back of the recording sheet has been prepared, second paper supply feed-out operation 608 is applied for the second time. Image write operation 609 is applied to the back of the recording sheet in conjunction with the PVV signal. The recording sheet is ejected out of the machine through the fixing apparatus 49, whereby a series of duplex copying operation terminates.

FIGS. 13 through 17 show an example of the job table used when the copying apparatus 10 manages the execution of a job. The job table is stored in the system memory 107. The job table 700 includes job data 701 as information common to each page of the job and page data 702 as information differing for each page. The data registered in the job data 701 includes the items that are set at the time of job start without being changed thereafter, and the items that are set during execution of the job. The items not changed subsequent to start of the job include the number of setting sections, copy mode, output mode, tray used, output size, document binding direction, document type, set direction, document size, output binding direction and others. One of the ADF single side, ADF double side and platen modes are set as the copy mode out of these items. One of the single side or double side mode is set as the output mode.

The items to be set during execution of the job include the number of outputted copies, number of read images, and number of written images and others. They are updated for every execution of the relevant processing. For the copy mode, output mode, tray used, document binding direction, document type, document set direction, output binding direction out of the job data 701, the contents of set data registration table 430 as shown in FIG. 6 are copied when the copy start button has been pressed. The page number, image rotation angle at the time of output and image data storage address are registered in the page data 702 for each page. By referring to this job table, the image control CPU 110 controls the contents displayed on the operation display section 220, document read operation and image write operation.

Setting of various data items to the job table 700 is carried out by processing of image read preparation and image writing preparation. In the duplex copying mode, image read preparation processing 621 is applied, as shown in FIG. 12, immediately before the document read operation 602 is applied to the front of the document. Image write preparation processing 623 is applied immediately before the image write operation 607 is applied to the front of the recording sheet. Image write preparation processing 624 is applied to the back of the recording sheet immediately before the image write operation 609 is applied to the back of the recording sheet.

FIG. 14 shows an example of the job table 710 where the data is set by image read preparation processing 621 applied to the front of a document. FIG. 15 shows an example of the job table 720 where the data is set by image read preparation processing 622 applied to the back of a document. FIG. 16 shows the job table 730 where the data is set by image write preparation processing 623 applied to the front of recording sheet. FIG. 17 shows the job table 740 where the data is set by image write preparation processing 624 to the back of recording sheet.

Figure 18:
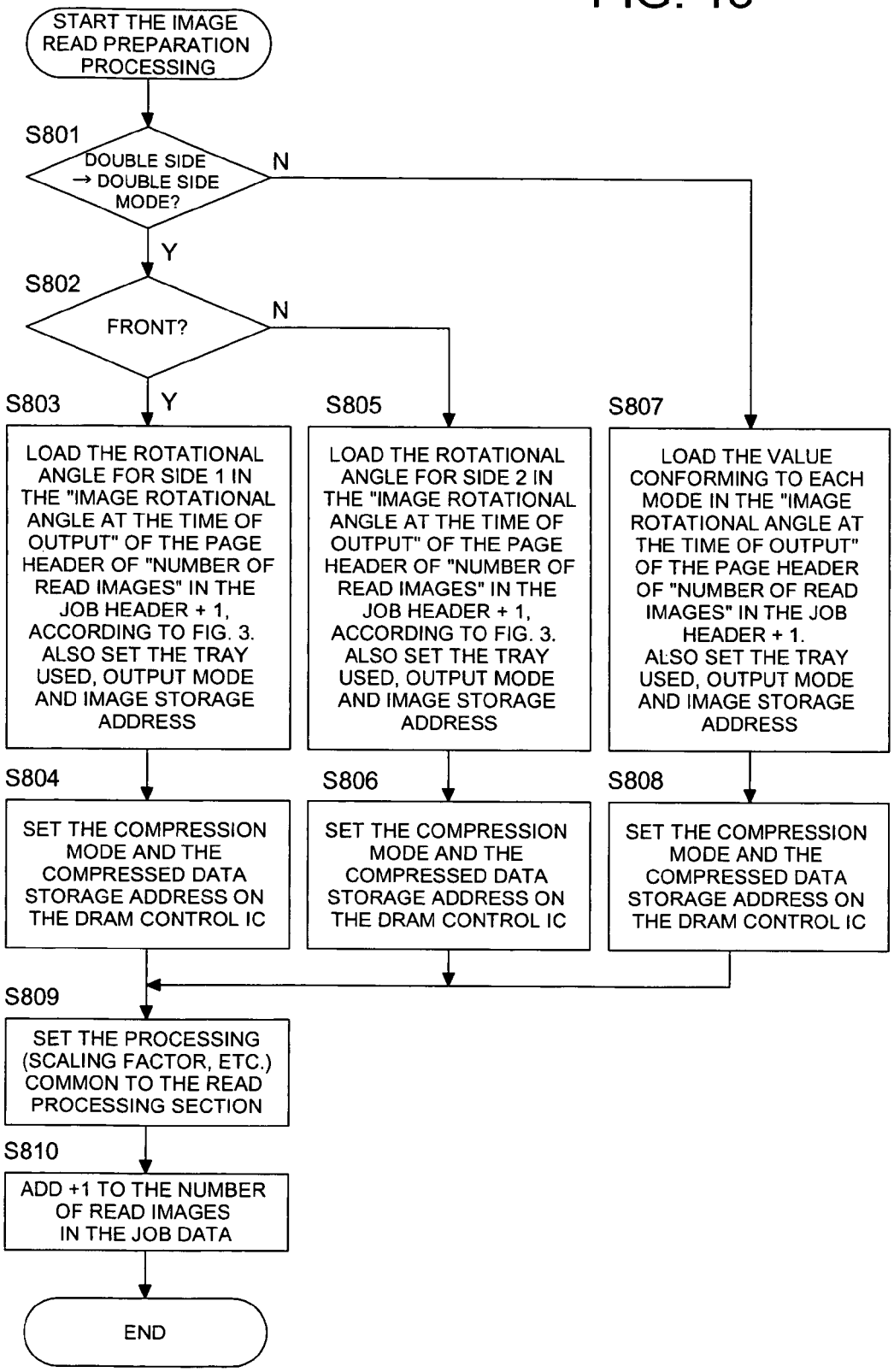
FIG. 18 is a flowchart showing image read preparation processing applied by a copying apparatus as an embodiment of the present invention.

FIG. 18 shows the flow of image read preparation processing. When the copy mode is based on "double side →double side" (Step S801; Y) and the front of the document is read (Step S802; Y), the rotational angle for SIDE 1 is stored in the "Image rotational angle at the time of outputting" column of the page data having the page number obtained by adding "1" to the value in the "number of read images" column 714, according to the rotational angle list 300 (Step S803). For example, when the document is based on "A4, Normal set, Lateral bind" and the recording sheet is based on the "A4, Lateral bind", as in the case of the job table 710 shown in FIG. 14, a combination given in the topmost row of FIG. 3 corresponds to this condition. Accordingly, 0 degree is set to the "Image rotational angle at the time of outputting" column 711 of the page data. Further, an image storage address is set to the "image storage address" column 712, and the tray used and output mode are set to the job data 713.

The compression mode (compression execution request) is set on the DRAM control section 102, and the compressed data storage address is set (Step S804). Then the scaling factor and others are set on the reading processing section 101 (Step S809), and "+1" is added to the value in the "number of read images" column 714 of the job data 713 (Step S810), thereby terminating the entire processing (END).

When the back of the document is read (Step S802; N), the rotational angle for SIDE 2 is stored in the "image rotational angle at the time of output" column of the page data having the page number obtained by adding "+1" to the value of "number of read images" 724 in the job data, according to the rotational angle list 300 (Step S805). In the job table 720 shown in FIG. 15, a combination given in the topmost row of FIG. 3 corresponds to this condition. Accordingly, 0 degree is set to the "Image rotational angle at the time of outputting" column 721. Further, an image storage address is set to the "image storage address" column 722, and the tray used and output mode are set to the job data 723.

The compression mode (compression execution request) is set on the DRAM control section 102, and the compressed data storage address is set (Step S806). Then the scaling factor and others are set on the reading processing section 101 (Step S809), and "+1" is added to the value in the "number of read images" column 724 of the job data 713 (Step S810), thereby terminating the entire processing (END).

When the copy mode is not based on "double side→double side" (Step S801; N), the value according to each mode. is set in the "Image rotational angle at the time of outputting" column of the page data having the page number obtained by adding "1" to the value in the "number of read images" column. Further, the tray used and output mode and image storage address are set (Step S807).

The compression mode (compression execution request) is set on the DRAM control section 102, and the compressed data storage address is set (Step S808). Then the scaling factor and others are set on the reading processing section 101 (Step S809), and "+1" is added to the value in the "number of read images" column of the job data (Step S810), thereby terminating the entire processing (END).

Figure 19:
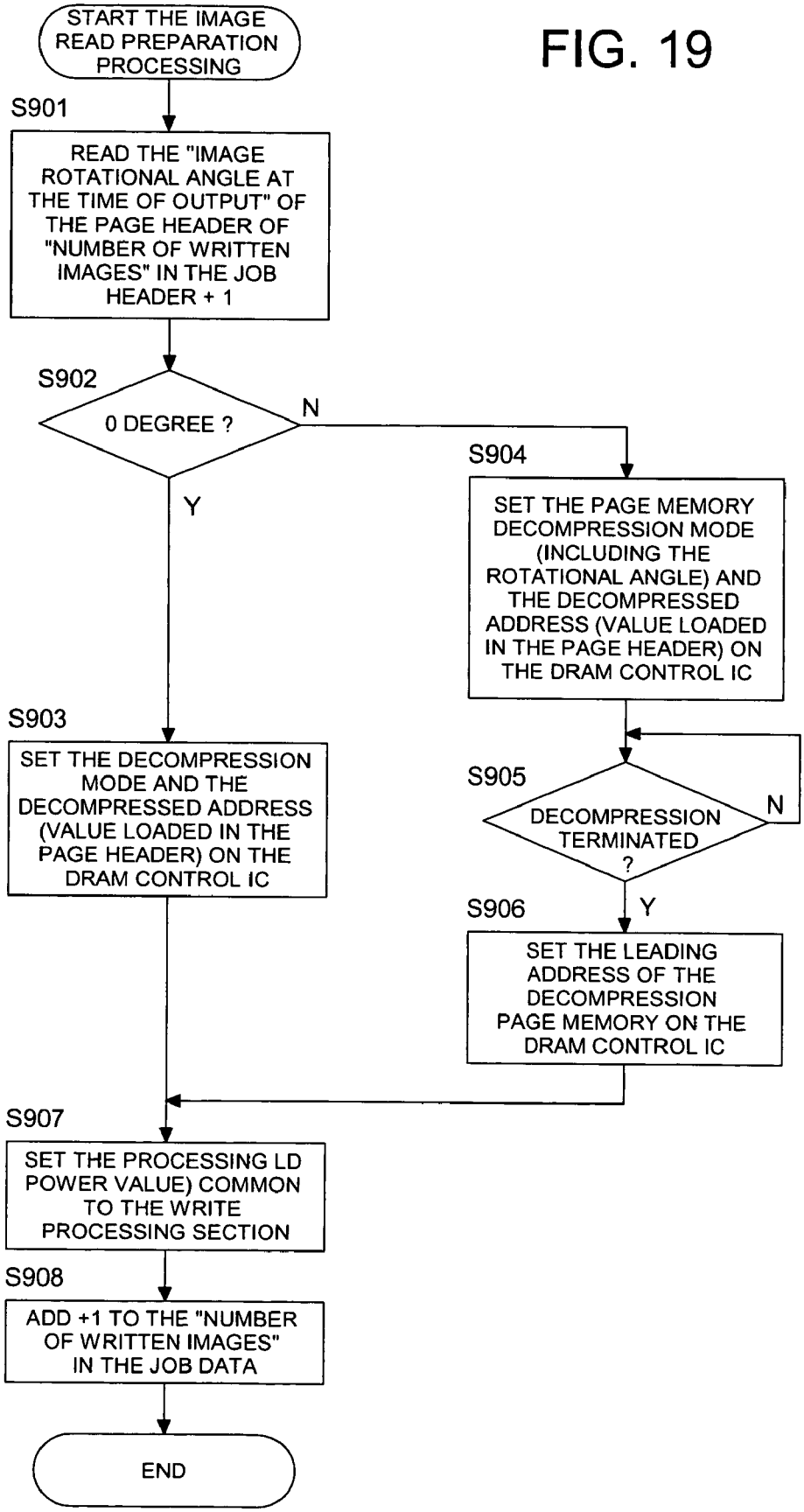
FIG. 19 is a flowchart showing the image write preparation processing applied by a copying apparatus as an embodiment of the present invention.
Figure 20:
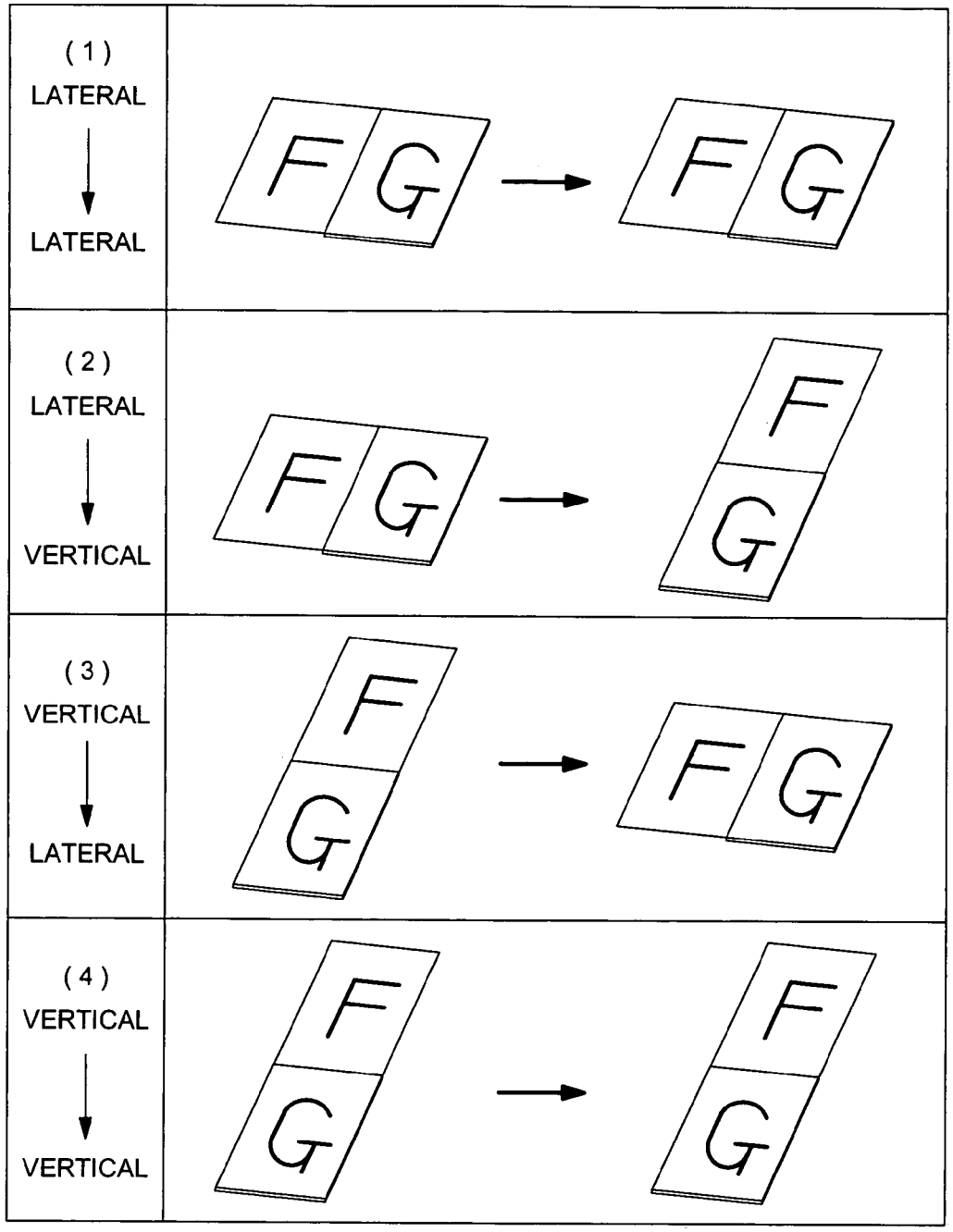
FIG. 20 is an explanatory diagram showing an example of combinations between document binding direction and output binding direction.

FIG. 19 shows the flow of image write preparation processing. The system reads the rotational angle stored in the "Image rotational angle at the time of outputting" column of the page data having the page number obtained by adding "1" to the value in the "number of written images" column in the job data (Step S901). If this angel is 0 (Step S902: Y), decompression mode (decompression execution request) is set to the DRAM control section 102, and the decompression address (image storage address stored in the page data of the relevant page) is set (Step S903).

After that, such a setting common to the write processing section 105 as setting of the laser diode power is carried out (Step S907). "+1" is added to the value in the "number of written images" of the job data (Step S908), thereby terminating the entire processing (END). If the "determined number of images" (not illustrated) in the job data is the same as the result of adding "+1", "+1" is added to the value in the "number of outputted copies" of the job data, and the value in the "number of written images" column is reduced to "0". This processing is also performed at the same time.

In the image write preparation processing 623 applied to the front of the recording sheet as shown in FIG. 12, image write preparation processing is performed with reference to the job table 730 shown in FIG. 16. In other words, reference is made to the "image rotational angle at the time of output" column 733 and "image storage address" column 734. In the image write preparation processing 624 applied to the back of the recording sheet, image write preparation processing is performed with reference to the job table 740 shown in FIG. 17. In other words, the value in "the number of written images" 742 is "1", so reference is made to the "image rotational angle at the time of output" column 743 and "image storage address" column 744 of the page data on the second page.

If the rotational angle read out from the "image rotational angle at the time of output" column of the relevant data base is not zero (Step S902; N), the page memory decompression mode (including rotational angle) is set on the DRAM control section 102, and the decompression address is set (Step S904). After that, the leading address of the compressed data memory 104*a* as a destination for decompression is set on the DRAM control section 102 (Step S906). After that, the above-mentioned steps S907 and S908 are executed, thereby terminating the processing.

Embodiments of the present invention have been described with reference to drawing. Specific configurations are not restricted to the ones given in the embodiments. Any modification and addition without departing from the spirit of the invention should be included in the present invention. For example, the rotational angle shown in FIG. 3 depends on the method of reversing the recording sheet in the copying machine. An appropriate value is adopted in response to the configuration of the copying machine to which the present invention is applicable.

In the present embodiment, reference is made to only the "top binding" in the description of vertical binding. It is also possible to refer to the "top/bottom binding" where bottom binding is included. For The top binding and bottom binding, the required rotational angle of the image remains the same.

In the embodiment, the copying machine equipped with only the copying function has been used in the above-mentioned description. It should be noted that the present invention is applicable to the so-called digital composite machine characterized by the aforementioned function plus printer and facsimile functions integrally combined.

What is claimed is:

1. An image forming apparatus for recording images of a double sided original on both sides of a recording sheet, the image forming apparatus comprising:

an image reader for reading the images of the double sided original;

a duplex printing section which prints the images on both sides of the recording sheet;

a first setting section which is capable of setting binding directions of the double sided original by designating a first original binding direction where image directions of front and back surfaces of the double sided original are in the same direction and a second original binding direction where image directions of front and back surfaces of the double sided document are in reverse directions, and which sets one of the first and second original binding directions;

a second setting section which is capable of setting binding directions of the recording sheet by designating a first recording sheet binding direction where recorded image directions on front and back surfaces of the recording sheet are in the same direction and a second recording sheet binding direction where recorded image directions of front and back surfaces of the recording sheet are in reverse directions, and which sets one of the first and second recording sheet binding directions;

an automatic setting section which sets a binding direction of the recording sheet same as the binding direction of the double sided original set by the first setting section; and an image rotator for making required amount of rotations of an image read by the image reader, based on a first relation between the binding direction of the double sided original having been set by the first setting section and the binding direction of the recording sheet having been set by the second setting section or based on a second relation between the binding direction of the double sided original having been set by the first setting section and the binding direction of the recording sheet having been set by the automatic setting section.

2. The image forming apparatus of claim 1, further comprising a notifying section for notifying to the effect that the binding direction of the recording sheet is set or notifying the binding direction of the recording sheet having been set.

3. The image forming apparatus of claim 1, further comprising a control section, wherein in cases where the binding direction of the recording sheet is set by the second setting section, the control section controls such that the binding direction set by the second setting section is in preference to the binding direction set by the automatic setting section.

4. The image forming apparatus of claim 3, wherein in cases where the binding direction of the double sided original is set by the first setting section after the binding direction of the recording sheet has been set by the second setting section, the control section controls such that the binding direction set by the automatic setting section is in preference to the binding direction set by the second setting section.

5. The image forming apparatus of claim 3, wherein in cases where the binding direction of the double sided original is set by the first setting step after the binding direction of the recording sheet has been set by the second setting step, the control step controls such that the binding direction set by the automatic setting step is in preference to the binding direction set by the second setting step.

6. The image forming apparatus of claim 1, wherein the image reader reads the images by a read-through method where the images are read by a stationary sensor while an original passes through the sensor.

7. The image forming apparatus of claim 1, wherein the duplex printing section prints the images by an electrophotographic process.

8. An image forming method for recording images of a double sided original on both sides of a recording sheet, the image forming method comprising:

a step of reading the images of the double sided original;

a first setting step capable of setting a binding directions of the double sided original by designating a first original binding direction where image directions of front and back surfaces of the double sided original are in the same direction and a second original binding direction where image directions of front and back surfaces of the double sided document are in reverse directions, wherein one of the first and second original binding directions is set in the first setting step;

a second setting step capable of setting binding directions of the recording sheet by designating a first recording sheet binding direction where recorded image directions on front and back surfaces of the recording sheet are in the same direction and a second recording sheet binding direction where recorded image directions of front and back surfaces of the recording sheet are in reverse directions wherein one of the first and second recording sheet binding directions is set in the second setting step;

an automatic setting step of setting automatically a binding direction of the recording sheet same as the binding direction of the double sided original set by the first setting section;

an image rotation step of making required amount of rotations of images having been read, based on a first relation between the binding direction of the double sided original having been set by the first setting step and the binding direction of the recording sheet having been set by the second setting step or based on a second relation between the binding direction of the double sided original having been set by the first setting step and the binding direction of the recording sheet having been set by the automatic setting step; and a printing step of printing images rotated by the image rotation step on both sides of the recording sheets.

9. The image forming method of claim 8, further comprising a notifying step of notifying to the effect that the binding direction of the recording sheet is set or notifying the binding direction of the recording sheet having been set.

10. The image forming method of claim 8, further comprising a control step, wherein in cases where the binding direction of the recording sheet is set by the second setting step, the control step controls such that the binding direction set by the second setting step is in preference to the binding direction set by the automatic setting step.

11. The image forming method of claim 8, wherein in the step of reading the images, the images are read by a read-through method where the images are read by a stationary sensor while an original passes through the sensor.

12. The image forming method of claim 8, wherein in the printing step, the images are printed by an electrophotographic process.

13. An image forming apparatus for recording images of a double sided original on both sides of a recording sheet, the image forming apparatus comprising:

an image reader for reading the images of the double sided original;

a duplex printing section which prints the images on both sides of the recording sheet;

a first setting section which is capable of setting binding directions of the double sided original by manually designating a first original binding direction where image directions of front and back surfaces of the double sided original are in the same direction and a second original binding direction where image directions of front and back surfaces of the double sided document are in reverse directions, and which sets one of the first and second original binding directions;

a second setting section which is capable of setting binding directions of the recording sheet by manually designating a first recording sheet binding direction where recorded image directions on front and back surfaces of the recording sheet are in the same direction and a second recording sheet binding direction where recorded image directions of front and back surfaces of the recording sheet are in reverse directions, and which sets one of the first and second recording sheet binding directions;

an automatic setting section which automatically sets a binding direction of the recording sheet same as the binding direction of the double sided original set by the first setting section;

an image rotator which rotates an image read by the image reader with a required amount of rotation angle; and a rotation angle determination section, which determines the required amount of rotation angle based on a first relation between the binding direction of the double sided original having been set by the first setting section and the binding direction of the recording sheet having been set by the second setting section when the binding direction of the recording sheet is set by the second setting section, or based on a second relation between the binding direction of the double sided original having been set by the first setting section and the binding direction of the recording sheet having been set by the automatic setting section when the binding direction of the recording sheet is set by the second setting section.

* * * * *